US008139806B2

(12) United States Patent
Hosaka et al.

(10) Patent No.: US 8,139,806 B2
(45) Date of Patent: Mar. 20, 2012

(54) EARPHONE FOR PLACEMENT IN AN EAR

(75) Inventors: Akihiko Hosaka, Gyeonggi-do (KR); Hyeon-goo Yoon, Suwon-si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 1423 days.

(21) Appl. No.: 11/710,984

(22) Filed: Feb. 27, 2007

(65) Prior Publication Data

US 2008/0013774 A1 Jan. 17, 2008

(30) Foreign Application Priority Data

Jul. 14, 2006 (KR) ..... 10-2006-0066130

(51) Int. Cl.
*H04R 25/00* (2006.01)

(52) U.S. Cl. ..... 381/373; 381/370; 381/380

(58) Field of Classification Search ..... 381/312, 381/328, 322, 380, 370, 374, 373; 379/430; 455/575.2; 181/129, 130, 135, 128
See application file for complete search history.

(56) References Cited

U.S. PATENT DOCUMENTS

| | | | |
|---|---|---|---|
| 4,972,492 | A | 11/1990 | Tanaka et al. |
| 5,396,563 | A | 3/1995 | Yoshimi |
| 5,692,059 | A | 11/1997 | Kruger |

FOREIGN PATENT DOCUMENTS

| | | | |
|---|---|---|---|
| EP | 0825796 | A2 | 2/1998 |
| GB | 2187361 | A | 2/1987 |
| JP | 09-009383 | | 1/1997 |
| JP | 09-084170 | | 3/1997 |

*Primary Examiner* — Tuan Nguyen
(74) *Attorney, Agent, or Firm* — Roylance, Abrams, Berdo & Goodman, L.L.P.

(57) ABSTRACT

An earphone which fits into an ear is disclosed. The earphone includes an electroacoustic transducer for converting an audio signal into sound and a housing for holding the electroacoustic transducer. The housing includes a sound output unit for introducing the sound produced by the electroacoustic transducer into the ear canal of an ear when the housing is placed in the ear. The electroacoustic transducer is oriented so that it the sound in a direction which is transverse to the ear canal of the ear.

30 Claims, 7 Drawing Sheets

EARPHONE FOR PLACEMENT IN AN EAR

CROSS-REFERENCE TO RELATED APPLICATIONS

This application claims the benefit under 35 U.S.C. §119 (a) of Korean Patent Application No. 2006-66130, filed on Jul. 14, 2006, in the Korean Intellectual Property Office, the entire disclosure of which is hereby incorporated by reference.

BACKGROUND OF THE INVENTION

1. Field of the Invention

The present invention relates to an earphone. More particularly, the present invention relates to an earphone which is used by placing it inside an ear.

2. Description of the Related Art

FIGS. 1 and 2 are schematic views illustrating a conventional earphone such as the one disclosed in Korean Laid-Open Patent Publication No. 10-1998-018579, which is hereby incorporated by reference in its entirety.

As illustrated in FIGS. 1 and 2, a conventional earphone 1 includes a cover connected to and combined with an earphone cord 5 at its lower part, an electroacoustic transducer 10 located inside the cover 4, a protection plate 2 combined with a front side of the cover 4 so that the electroacoustic transducer 10 is protected, and an ear piece 3 in a predetermined shape located outside the protection plate 2.

The electroacoustic transducer 10 for converting an audio signal to sound may be, for example, a moving coil type transducer. In this type of a transducer, a voice coil is wound around a bobbin 12, and the bobbin 12 is integrally attached to a diaphragm 11. The voice coil or diaphragm is inserted into a gap 14 in a magnetic circuit 13.

The protection plate 2 which opposes the diaphragm 11 is provided on a sound emanating side or front side of the transducer 10 and is made of a metal plate of substantially the same size as the diaphragm 11. The protection plate 2 has a number of holes 21 through to allow sound waves emitted from the diaphragm 11 to pass through.

The ear piece 3 covers the front side of the protection plate 2. The ear piece 3 is located within a listener's ear when the earphone 1 is worn. The ear piece 3 has a protruding portion 30 that fits into an entrance of the external auditory meatus (i.e., the ear canal). The protruding portion 30 is made of a material having an appropriate elasticity, such as rubber or plastic. The tip of the protruding portion 30 has a number of sound emanating holes 31.

The cover 4 covers a rear face of the transducer 10. The transducer 10 is connected to the earphone cord 5 through an introducing portion 40, which is located at a lower part of the cover 4. An air chamber 41 inside the cover 4 is open to the outside through a passage 42 of the introducing portion 40. The cover 4 is provided with a number of holes 43 which are closed by an acoustic resistant material 44.

An air chamber 32 is formed in front of the transducer 10 by the ear piece 3. The air chamber 32 is open to the outside through an opening 34 and a non-woven fabric 35 which are formed on the ear piece 3. The opening 34 is located to the side of the central portion of the ear piece 3 as shown in FIG. 2. Thus, when the earphone 1 is put in the ear E such that the protruding portion 30 is inserted into the ear canal or the external auditory meatus, the opening 34 is located in the cavum concha F, thereby covering the skin of the cavum concha F.

In the conventional earphone 1, the whole earphone 1 including the protection plate 30 and the cover 4 is inserted into and supported by the cavum concha F, and the introducing portion 40 of the cover 4 is introduced into and supported by the intertragic notch. If a user wears the earphone for a long time, the pressure on the anti-tragus H and the tragus G, or the contact with a protruding portion of a helix K may cause discomfort.

Furthermore, since the protruding portion 30 of the ear piece 3 is at the front of the transducer 10, when the earphone 1 is inserted into the external auditory meatus, the transducer 10 is almost horizontal with respect to the cavum concha F. Accordingly, the opening 34 and the nonwoven fabric 35 contact the cavum concha F. When the opening 34 of the ear piece 3 is blocked by the cavum concha F, low frequency sounds (i.e., bass sounds) generated by the transducer 10 cannot be transmitted. Furthermore, the opening 34 of the ear piece 3 is adjacent to the protection plate 2. Thus, there is only a small space created in the ear piece 3 where the opening 34 is provided, and bass sounds may be muted.

Accordingly, there is a need for an improved earphone for insertion into the ear canal that provides increased comfort and better sound quality.

SUMMARY OF THE INVENTION

An aspect of the present invention is to address at least the above problems and/or disadvantages and to provide at least the advantages described below. Accordingly, an aspect of the present invention is to provide an earphone which has an improved structure to improve the comport when wearing the earphone and the sound quality.

In accordance with an aspect of an exemplary embodiment of the present invention, an earphone includes an electroacoustic transducer for converting an audio signal into sound and a housing for holding the electroacoustic transducer. The housing includes a sound output unit for introducing the sound produced by the electroacoustic transducer into the ear canal of an ear when the housing is placed in the ear. The electroacoustic transducer emits sound in a direction transverse to the ear canal of the ear.

The sound emission direction of the electroacoustic transducer may be substantially parallel to a side of a cavum concha of the ear.

The housing may includes a front housing that surrounds the front of the electroacoustic transducer and a rear housing, that is combined with the front housing and surrounds the rear of the electroacoustic transducer.

The rear housing may include a rear wall that surrounds the rear of the electroacoustic transducer and a base wall that extends from the rear wall to the front of the electroacoustic transducer and forms the sound output unit, together with the front housing.

The base wall may be adapted to contact the side of the cavum concha of the ear.

The front housing may include a front wall located at an angle with respect to the front of the electroacoustic transducer and a protruding extension wall extending from the front wall and forming the sound output unit, together with the base wall.

The housing may include a first space located in the rear of the electroacoustic transducer and a second space located in the front of the electroacoustic transducer. The second space is larger than the first space and is operatively connected to the sound output unit.

The housing includes may include a rear opening operatively connecting the first space to the outside and a front opening adjacent to the front of the electroacoustic transducer and operatively connecting the second space to the outside.

The rear opening may include a cover including a non-woven fabric.

A cover may cover a portion of the housing and contact the ear. The cover may include an exit corresponding to the sound output unit.

The cover may be made of a flexible material, and the exit may be spaced apart from the sound output unit by a distance. The distance is controllable when the shaped of the cover is changed.

A supporting protrusion may be located at a lower part of the outside of the housing, and the supporting protrusion may protrude outwardly with a shape that corresponds to the anti-tragus notch of the ear when the housing is placed in the ear.

In accordance with another aspect of an exemplary embodiment of the present invention, an earphone includes an electroacoustic transducer for converting an audio signal into sound and a housing for holding the electroacoustic transducer. The housing includes a sound output unit for introducing the sound produced by the electroacoustic transducer into the ear canal of an ear when the housing is placed in the ear, and wherein the electroacoustic transducer is at an angle of 90°±10° with respect to a side of the cavum concha when the housing is placed in the ear.

The housing may include a substantially circular first body for holding the electroacoustic transducer, a second body that protrudes from the first body and extends from the front of the electroacoustic transducer to the ear canal of the ear, a third body that extends from the first body and extends substantially parallel to the electroacoustic transducer in parallel, and a cord connected to the electroacoustic transducer disposed in the third body.

The sound output unit may be located at a protruding tip of the second body.

The second body may include a base side which faces the side of the cavum concha so that it can be placed against the cavum concha.

A supporting protrusion may be disposed on the second body so that it protrudes outwardly in a shape corresponding to the shape of the anti-tragus notch of the ear when the housing is placed in the ear.

The housing may include a first space located in the rear of the electroacoustic transducer and a second space located in the front of the electroacoustic transducer. The second space is larger than the first space and is operatively connected to the sound output unit.

The housing may include a rear opening operatively connecting the first space to the outside and a front opening adjacent to the front of the electroacoustic transducer and operatively connecting the second space to the outside.

A bushing member may be combined with the housing. The bushing member supports a cord which is connected to the electroacoustic transducer to enter from the outside of the housing.

The first space may be operatively connected to a cord hole of the bushing member.

A cover may cover a portion of the housing that contacts the ear, and may include an exit corresponding to the sound output unit.

In accordance with another aspect of an exemplary embodiment of the present invention, an earphone includes a housing adapted to hold an electroacoustic transducer. The housing includes a sound output unit for introducing sound emitted by the electroacoustic transducer into an ear canal of an ear. The housing holds the electroacoustic transducer so that it emits sound in a direction transverse to the ear canal.

The electroacoustic transducer may emit sound in a direction substantially parallel to the cavum concha.

The housing may include a front housing disposed at the front of the electroacoustic transducer and a rear housing disposed at the rear of the electroacoustic transducer.

The rear housing may form a first space located in the rear of the electroacoustic transducer and the front housing may form a second space located in the front of the electroacoustic transducer.

The second space may be larger than the first space and may be operatively connected to the sound output unit.

At least one opening may be provided to connect the first space to an exterior of the housing. The at least one opening controls the treble response of the sound emitted from the electroacoustic transducer.

At least one opening may be provided to connect the second space to an exterior of the housing. The at least one opening controls the bass response of the sound emitted from the electroacoustic transducer.

In accordance with another aspect of an exemplary embodiment of the present invention, an earphone includes a front housing and a rear housing connected to the first housing to form an interior space. An electroacoustic transducer for emitting sound is disposed in the interior space formed by the front and rear housings. The electroacoustic transducer emits sound in a first direction. A sound output unit disposed on the front housing transmits sound emitted by the electroacoustic transducer into an ear canal of an ear in a second direction. The first and second directions are transverse to one another.

The first and second directions may be at an angle in the range of approximately 80° to 100° with respect to one another. The first and second directions may be at an angle of approximately 90° with respect to one another.

The interior space may include a first space between the electroacoustic transducer and the rear housing and a second space between the electroacoustic transducer and the front housing.

At least one opening may be provided to connect the first space to an exterior of the housing. The at least one opening controls the treble response of the sound emitted from the electroacoustic transducer.

At least one opening may be provided to connect the second space to an exterior of the housing. The at least one opening controls the bass response of the sound emitted from the electroacoustic transducer.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the exemplary embodiments of the invention and are merely exemplary. Accordingly, those of ordinary skill in the art will recognize that various changes and modifications of the exemplary embodiments described herein can be made without departing from the scope and spirit of the invention. Also, descriptions of well-known functions and constructions are omitted for clarity and conciseness.

Exemplary embodiments of the present invention will now be described in detail with reference to the accompanying drawings.

Figure 3:
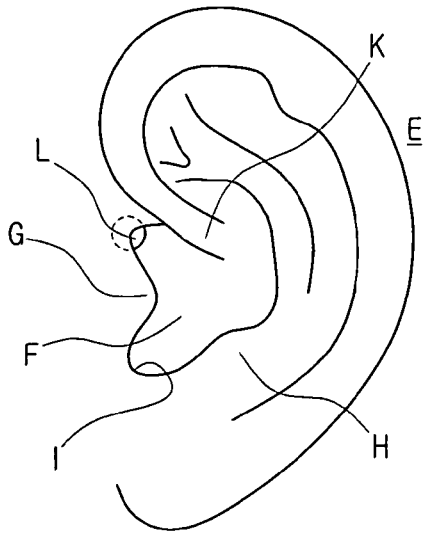
FIG. 3 is a view of an external ear.

FIG. 3 illustrates a structure of an ear E. The ear has a cavum concha F, a tragus G, an anti-tragus H, an intertragic notch I between the tragus and the anti-tragus, a helix K, and the external auditory L. The entrance of the external auditory meatus L is located at a side of the cavum concha F and partially covered by the tragus G.

The earphone in accordance with an exemplary embodiment of the present invention is worn in the ear E. The earphone extends over the tragus G, the anti-tragus H and the intertragic notch I. When the earphone is placed adjacent and the side of the earphone is basically aligned with the cavum concha F, the earphone introduces sound into the external auditory meatus L.

Figure 4A:
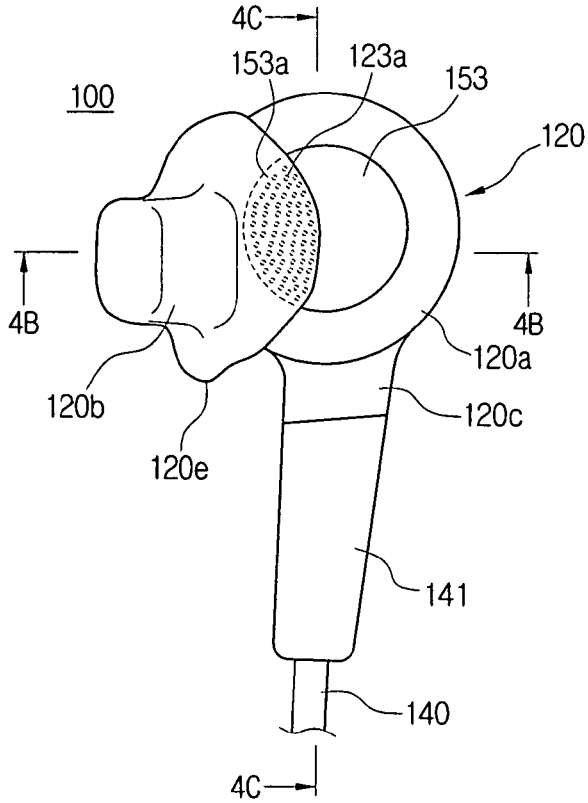
FIG. 4A is a left side view of an earphone in accordance with an exemplary embodiment of the present invention.
Figure 4B:
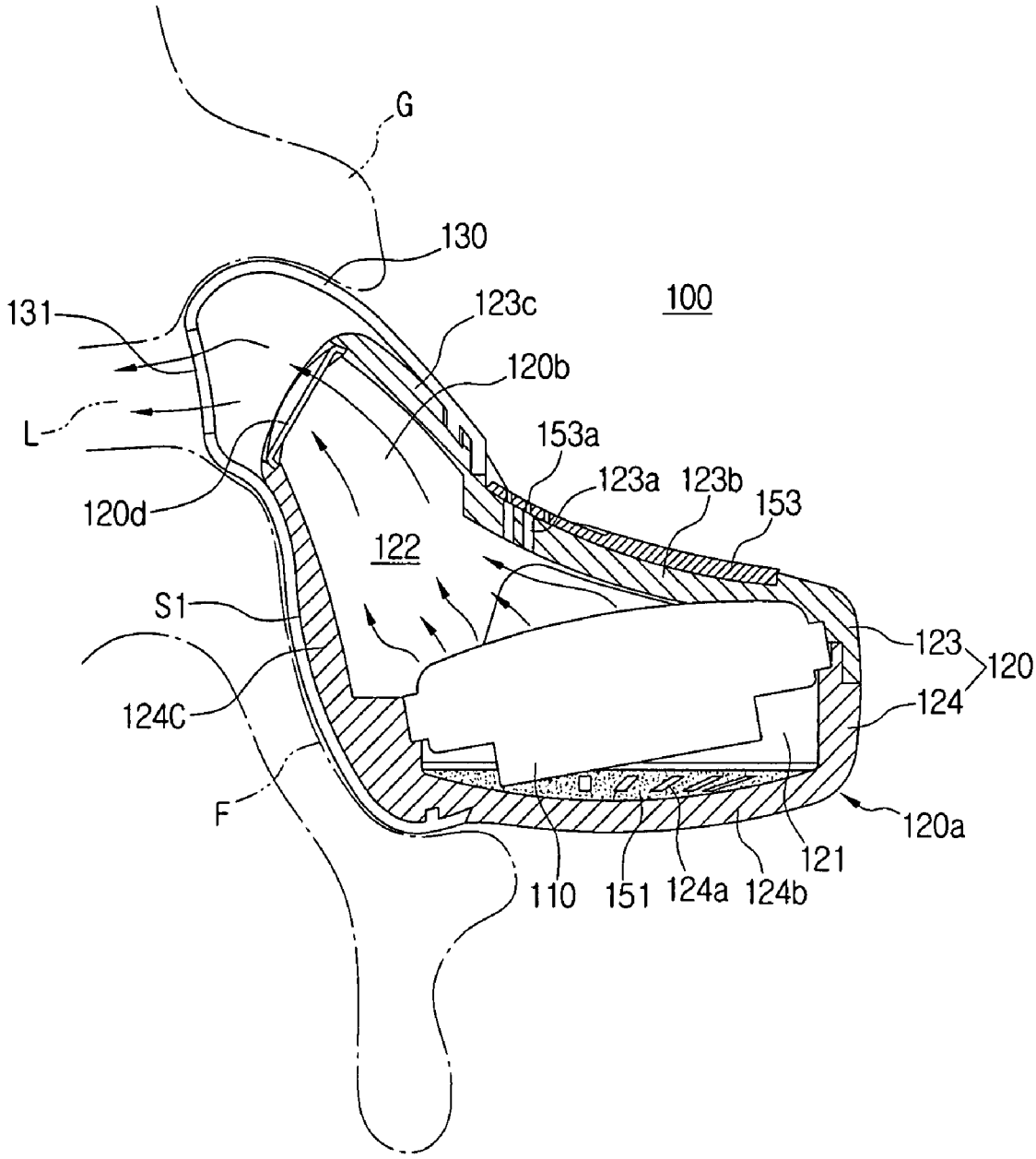
FIG. 4B is a sectional view taken along line 4B-4B of FIG. 4A.
Figure 4C:
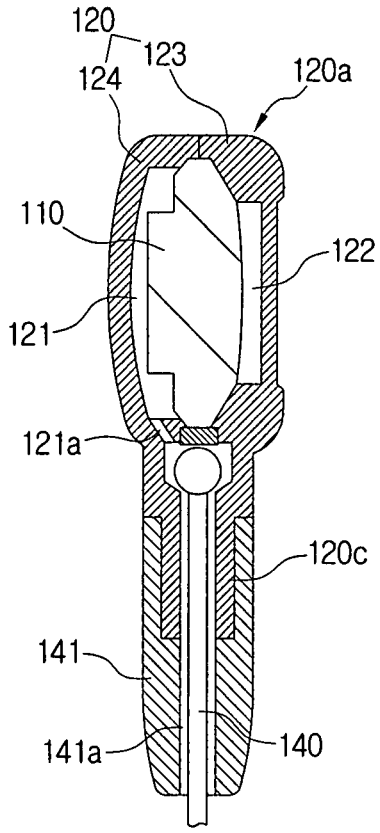
FIG. 4C is a sectional view taken along line 4C-4C of FIG. 4A.

As shown in FIGS. 4A, 4B and 4C, the earphone 100 in accordance with an exemplary embodiment of the present invention comprises an electroacoustic transducer 110, a housing 120, and a cover 130. The electroacoustic transducer 110 converts an audio signal into sound. The housing 120 receives the electroacoustic transducer 110 and is worn in a user's ear. The cover 130 is combined with the housing 120 and covers part of the housing 120.

Figure 1:
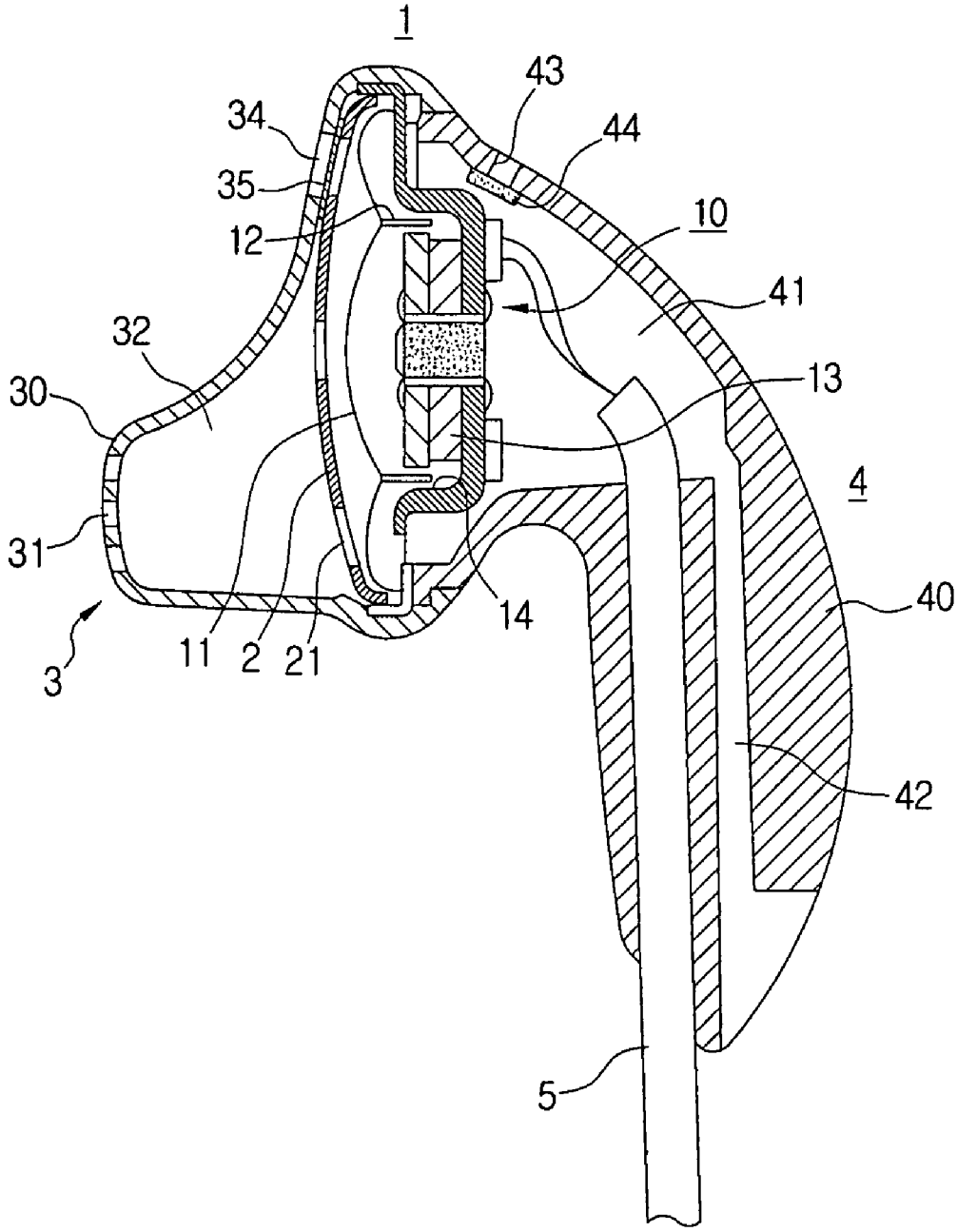
FIG. 1 (PRIOR ART)
FIG. 1 is a schematic view of a conventional earphone.
Figure 2:
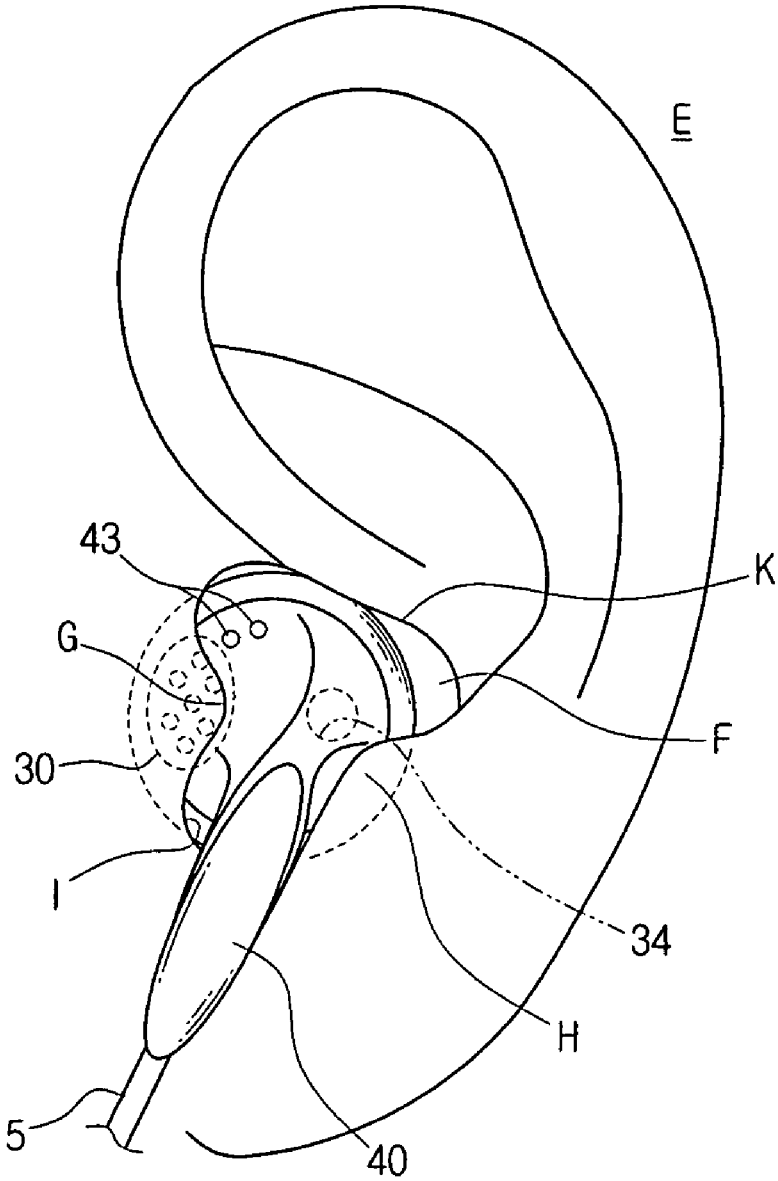
FIG. 2 (PRIOR ART)
FIG. 2 is a plan view of the earphone of FIG. 1 in an ear.

The electroacoustic transducer 110 converts an audio signal transferred through a cord into a sound signal to be output. The structure of the electroacoustic transducer 110 may be same as that used for a typical, conventional earphone. That is, the electroacoustic transducer 110 may have the same structure as the conventional electroacoustic transducer 10 described with respect to FIGS. 1 and 2. The electroacoustic transducer may also be any type of sound element known to those of skill in the relevant art.

The housing 120 is divided into a first body 120*a*, a second body 120*b*, and a third body 120*c*. The first body 120*a* covers the electroacoustic transducer 110 and has a shape corresponding to the electroacoustic transducer 110. The second body 120*b* extends outwardly from the first body 120*a*. The third body 120*c* extends downwardly from the first body 120*a*.

Figure 5:
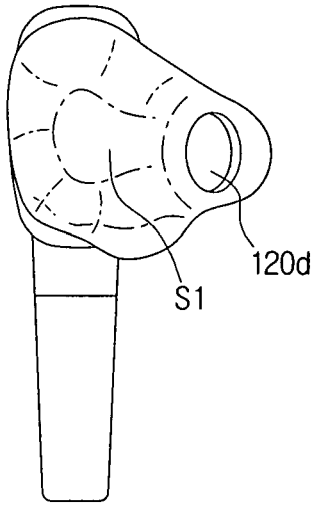
FIG. 5 is a front view of the earphone of FIGS. 4A-4C.

As illustrated in FIGS. 4B and 5, the housing 120 includes a sound output unit 120*d* that outputs the sound from the electroacoustic transducer 110 into the external auditory meatus L. The sound output unit 120*d* is located at a protruding tip of the second body 120*b*. The second body 120*b* extends forward from the electroacoustic transducer 110 to form an internal space 122. Sound is output into the external auditory meatus L through the sound output unit 120*d*, as indicated by arrows in FIG. 4B. When wearing the earphone in an ear, a base side S1 of the second body 120*b* faces a side of the cavum concha F so that they contact each other. For this purpose, as illustrated in FIGS. 4B and 5, the sound output unit 120*d* is located at one side of the base side S1. With this construction, the electroacoustic transducer 110 is almost vertical, i.e., at an angle of 90±10°, with respect to the side of the cavum concha F. The direction that the sound is output from the electroacoustic transducer 110 is at an angle of about 90° with respect to the external auditory meatus L. As illustrated in FIG. 4B, the direction of the sound output from the electroacoustic transducer 110 is changed, as indicated by the arrows, so that it transmitted to the entrance of the external auditory meatus L.

As illustrated in FIG. 4C, the third body 120*c* extends downwardly from the first body 120*a*. A cord 140 is connected to the electroacoustic transducer 110 and passes through the inside of the third body 120*c*. A bushing member 141 made of, for example, a rubber material, is disposed on the outside of the third body 120*c*.

As illustrated in FIGS. 4B and 4C, a first space 121 and a second space 122 are provided within the housing 120. The first space 121 is provided in the rear of the electroacoustic transducer 110, and the second space 122 is provided in the front of electroacoustic transducer 110. The second space 122 is larger than the first space 121 and transmits the sound output from the electroacoustic transducer 110 to the sound output unit 120*d*.

Figure 6:
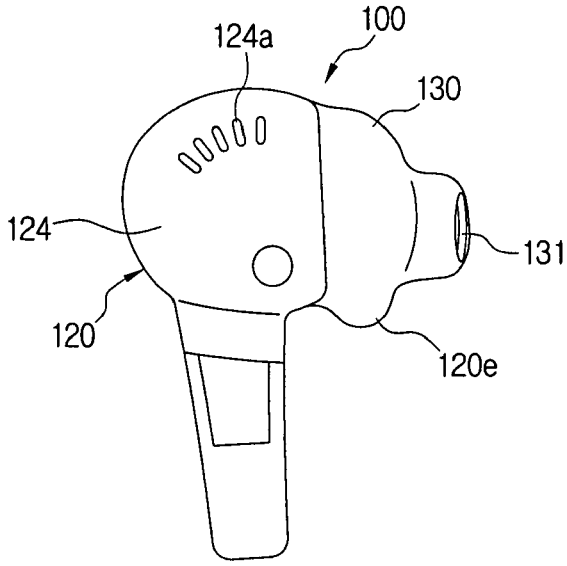
FIG. 6 is a right side view of the earphone of FIGS. 4A-4C.

As illustrated in FIGS. 4B and 6, a rear opening 124*a* is located at the rear of the housing 120. The rear opening 124*a* operatively connects the first space 121 to the outside. The rear opening 124*a* controls the treble response (i.e., higher frequencies) of the sound that is output from the electroacoustic transducer 110. The treble characteristics may be changed by varying the number and size of the rear opening 124*a*.

As illustrated in FIGS. 4A and 4B, a front opening 123*a* is formed in the front of the housing 120. The front opening 123*a* operatively connects the second space 122 to the outside. The front opening 123*a* controls the bass response (i.e., lower frequencies). The bass characteristics may be changed by varying the number and size of the front opening 123*a*.

A covering 151, such as a nonwoven fabric, is provided at a portion corresponding to the rear opening 124*a* inside the first space 121 of the housing 120.

As illustrated in FIGS. 4A and 4B, a decorative plate 153 may be combined with a front outer side of the housing 120. The decorative plate 153 includes holes 153*a* corresponding to the front opening 123*a*.

As illustrated in FIG. 4C, the first space 121 of the housing 120 is formed to be operatively connected to a cord hole 141*a* of the bushing member 141. Thus, the treble frequencies generated in the rear of the electroacoustic transducer 110 may be controlled by both the hole 141*a* of the bushing member 141 connected by the cord 140 and the rear opening 124*a*, as discussed above.

Figure 7:
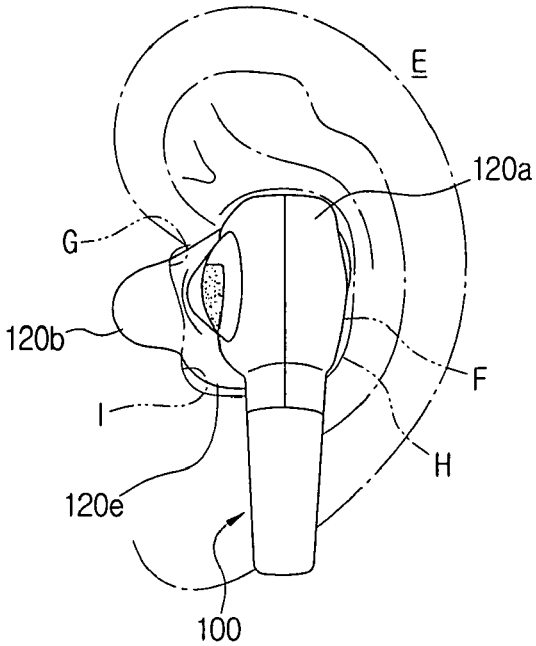
FIG. 7 is a view of the earphone of FIGS. 4A-4C while being worn in an ear.

The cover 130 covers a part of the housing 120, i.e., the protruding portion of the second body 120*b*. The cover 130 may be made of a flexible material, for example, rubber, so that it is easily placed on or removed from the housing 130. Accordingly, even though the cover 130 contacts a user's ear for a long time, it does not cause discomfort and prevents the earphone from sliding down. The cover 130 includes an exit 131 corresponding to the sound output unit 120*d*. The exit 131 is spaced apart from the sound output unit 120*d*, by a predetermined distance. The shape of the exit 131 for introducing the sound from the sound input unit 120*d* to the external auditory meatus L corresponds to the shape of the entrance of the external auditory meatus L. Since the cover 130 is made of the flexible material, the exit 131 will conform to the different shapes user's ears. As a result, even though the earphone is worn for a long time, a user experiences no discomfort. As illustrated in FIG. 7, when the earphone 100 is worn in the ear E, the cover 130 is supported by the tragus G, the anti-tragus H and the intertragic notch I and also contacts the side of the cavum concha F.

The housing 120 further includes a supporting protrusion 120*e* formed on the outside of the second body 120*b*. The supporting protrusion 120*e* has a protruding shape that corresponds to the shape of the intertragic notch I. When the earphone 100 is worn in the ear E, the supporting protrusion 120*e* contacts the intertragic notch I so that the protrusion 120*e* is stably supported.

In the above description, the housing 100 in accordance with the exemplary embodiment of the present invention is described with respect to the outer shape. The housing 100 may also be described with respect to other aspects, such as its construction. That is, as illustrated in FIG. 4C, the housing 120 may be divided into a front housing 123 and a rear housing 124 between which the electroacoustic transducer 110 is located. When the housings 123 and 124 are connected together, they form the housing 120 having the previously described first, second and third bodies 120*a*, 120*b* and 120*c*.

As illustrated in FIG. 4B, the front housing 123 includes a front wall 123*b* and a protruding extension wall 123*c*. The front wall 123*b* is at a predetermined angle with respect to the front of the electroacoustic transducer 110. The protruding extension wall 123*c* extends from the front wall 123*b* to the sound output unit 120*d*. The protruding extension wall 123*c* forms the sound output unit 120*d* and the second body 120*b*, together with a base wall 124*c* of the rear housing 124, which will be described below. The front opening 123*a* is located on the front wall 123*b*.

The rear housing 124 includes a rear wall 124*b* and a base wall 124*c*. The rear wall 124*b* surrounds the rear of the electroacoustic transducer 110. The base wall 124*c* extends, in a predetermined shape, from the rear wall 124*b* and is combined with the protruding extension wall 123*c* of the front housing 123. The base wall 124*c* is almost parallel to the side of the cavum concha F. The base wall 124*c* is at an angle of about 90±10° with the electroacoustic transducer 110. Thus, the electroacoustic transducer 110 is placed at an angle of about 90±10°, preferably, at an angle of 90° with the side of the cavum concha F. The base wall 124*c* is secured against the side of the cavum concha F.

When the earphone 100 in accordance with the exemplary embodiment of the present invention, which has the above-described constitution, is worn in the ear E, the electroacoustic transducer 110 is almost perpendicular to the side of the cavum concha F, as illustrated in FIGS. 4B and 7. Due to such a structure, the front opening 123*a* and the rear opening 124*a* are neither covered by nor contacted by the ear E even though the earphone 100 is worn in the ear E. Thus, it is possible to control excessive increases in bass tones generated by the electroacoustic transducer 110.

Figure 8:
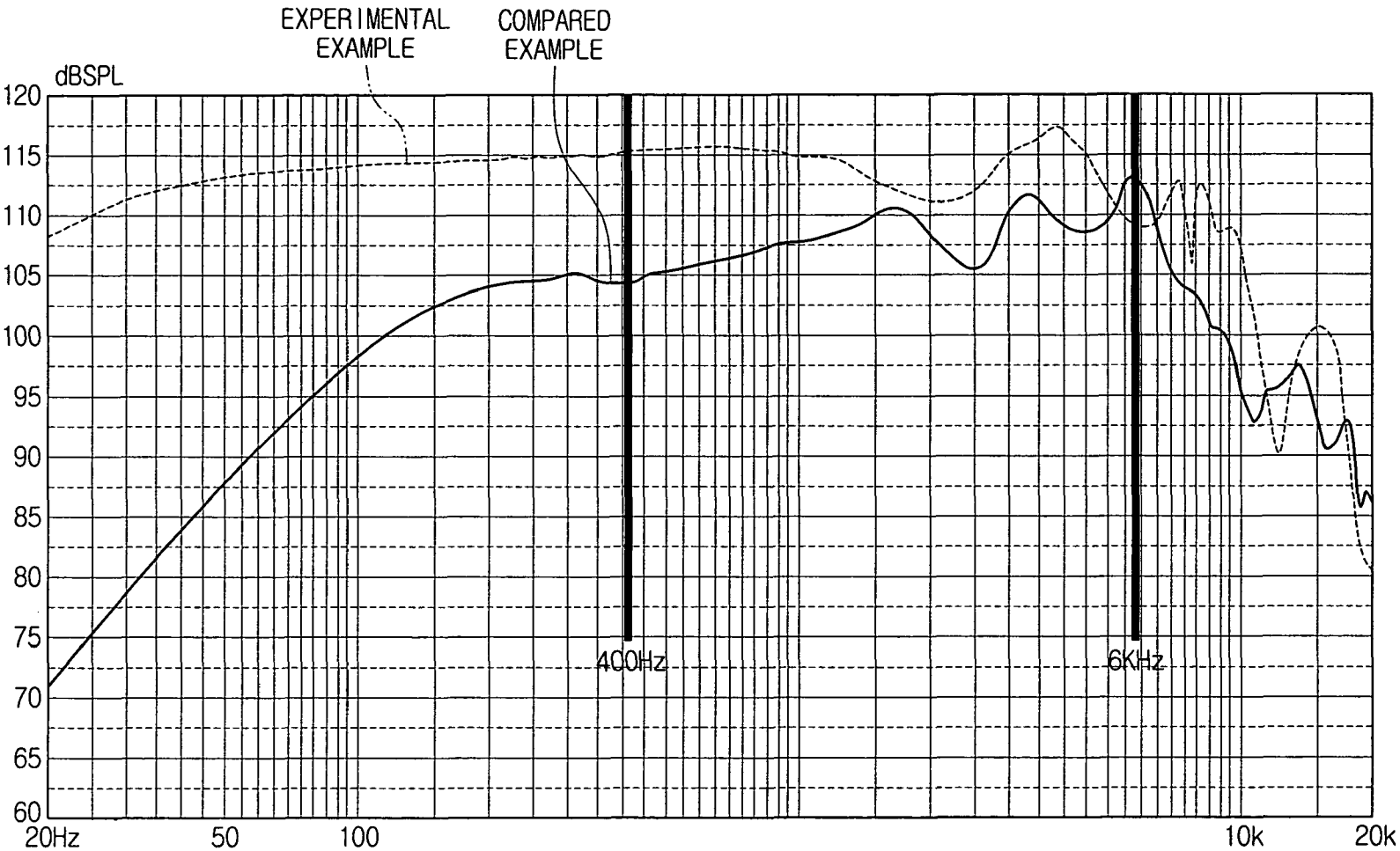
FIG. 8 is a graph of sound pressure showing a comparison of the earphone of FIGS. 4A-4C in and a conventional earphone.

Further, the second space 122 may be designed to be larger than a corresponding space in conventional earphones, according to the position of the electroacoustic transducer 110. Thus, since a sufficient resonance space is secured in the space from the electroacoustic transducer 110 to the sound output unit 120*d*, the bass response is increased and improved. As illustrated in FIG. 8, the results of experimental testing using the earphone 100 in accordance with the exemplary embodiments of the present invention show that the bass response of the earphone 100 is improved in comparison to a conventional earphone.

Further, since the electroacoustic transducer 110 is substantially perpendicular to the side of the cavum concha F, the second space 122 is less restricted in space. Thus, it is possible to form the shape of the second space 122, i.e., the second body 120*b*, to correspond to the shape of the ear E, thereby improving the comfort when wearing the earphone.

As described above, in accordance with the earphone of the present invention, when the earphone is worn in the ear, the electroacoustic transducer is substantially perpendicular to the side of the cavum concha. Consequently, the openings located at the front and rear of the earphone are not blocked by an ear, thereby effectively controlling the treble and bass frequency responses.

Furthermore, the space between the electroacoustic transducer to the sound output unit which reaches the external auditory meatus is larger, compared to a conventional earphone. Consequently, the resonance space is improved, thereby improving the bass response and improving the sound quality.

Furthermore, when the earphone is worn in the ear, a predetermined portion of the earphone, which reaches the external auditory meatus, is freely designed and formed in a shape corresponding to the shape of the ear, thereby improving comfort when wearing the earphone and minimizing discomfort caused by wearing the earphone for a long time.

While the invention has been shown and described with reference to certain embodiments thereof, it will be understood by those skilled in the art that various changes in form and details may be made therein without departing from the spirit and scope of the invention as defined by the appended claims and their equivalents.

What is claimed is:

1. An earphone comprising:

an electroacoustic transducer for converting an audio signal into sound; and a housing for holding the electroacoustic transducer, the housing including a sound output unit for introducing the sound produced by the electroacoustic transducer into the external auditory meatus of an ear when the housing is placed in the ear;

wherein a sound-emitting surface of the electroacoustic transducer is disposed in a direction transverse to the external auditory meatus of the ear; and wherein the housing comprises a first space located in the rear of the electroacoustic transducer, a second space located in the front of the electroacoustic transducer, and at least one rear opening connecting the first space to an exterior of the housing, the at least one rear opening controlling a treble response of the sound emitted from the electroacoustic transducer.

2. The earphone as claimed in claim 1, wherein a sound emission direction of the electroacoustic transducer is substantially parallel to a side of a cavum concha of the ear.

3. The earphone as claimed in claim 1, wherein the housing comprises:

a front housing that surrounds the front of the electroacoustic transducer; and a rear housing that is combined with the front housing and surrounds the rear of the electroacoustic transducer.

4. The earphone as claimed in claim 3, wherein the rear housing comprises:

a rear wall that surrounds the rear of the electro acoustic transducer; and a base wall that extends from the rear wall to the front of the electroacoustic transducer and forms the sound output unit, together with the front housing.

5. The earphone as claimed in claim 4, wherein the base wall is adapted to contact the side of the cavum concha of the ear.

6. The earphone as claimed in claim 4, wherein the front housing comprises:

a front wall located at an angle with respect to the front of the electroacoustic transducer; and a protruding extension wall extending from the front wall and forming the sound output unit, together with the base wall.

7. The earphone as claimed in claim 1, wherein the second space is larger than the first space and is operatively connected to the sound output unit.

8. The earphone as claimed in claim 1, further comprising:

a cover that covers a portion of the housing and contacts the ear, the cover including an exit corresponding to the sound output unit.

9. The earphone as claimed in claim 8, wherein the cover is made of a flexible material, the exit is spaced apart from the sound output unit by a distance, and the distance is controllable when the shaped of the cover is changed.

10. The earphone as claimed in claim 1, wherein a supporting protrusion is located at a lower part of an outside of the housing, and the supporting protrusion protrudes outwardly with a shape that corresponds to the anti-tragus notch of the ear when the housing is placed in the ear.

11. An earphone comprising:

an electroacoustic transducer for converting an audio signal into sound; and a housing for holding the electroacoustic transducer, the housing including a sound output unit for introducing the sound produced by the electroacoustic transducer into the external auditory meatus of an ear when the housing is placed in the ear;

wherein a sound-emitting surface of the electroacoustic transducer is disposed in a direction transverse to the external auditory meatus of the ear; and wherein the housing comprises a first space located in the rear of the electroacoustic transducer, a second space located in the front of the electroacoustic transducer, and a front opening adjacent to the front of the electroacoustic transducer and operatively connecting the second space to the outside of the housing, the front opening controlling a bass response of the sound emitted from the electroacoustic transducer.

12. The earphone as claimed in claim 1, wherein the rear opening includes a cover comprising a nonwoven fabric.

13. An earphone comprising:

an electroacoustic transducer for converting an audio signal into sound; and a housing for holding the electroacoustic transducer, the housing including a sound output unit for introducing the sound produced by the electroacoustic transducer into the external auditory meatus of an ear when the housing is placed in the ear, wherein a sound-emitting surface of the electroacoustic transducer is at an angle of 90°±10° with respect to a side of the cavum concha when the housing is placed in the ear; and wherein the housing comprises a first space located in the rear of the electroacoustic transducer, a second space located in the front of the electroacoustic transducer, and at least one opening connecting the first space to an exterior of the housing, the at least one opening controlling a treble response of the sound emitted from the electroacoustic transducer.

14. The earphone as claimed in claim 13, wherein the housing comprises:

a substantially circular first body for holding the electroacoustic transducer;

a second body that protrudes from the first body and extends from the front of the electroacoustic transducer to the external auditory meatus of the ear;

a third body that extends from the first body and extends substantially parallel to the electroacoustic transducer; and a cord connected to the electroacoustic transducer disposed in the third body.

15. The earphone as claimed in claim 14, wherein the sound output unit is located at a protruding tip of the second body.

16. The earphone as claimed in claim 14, wherein the second body comprises a base side which faces a side of the cavum concha of the ear so that it can be placed against the cavum concha.

17. The earphone as claimed in claim 14, further comprising a supporting protrusion on the second body, the supporting protrusion protruding outwardly in a shape corresponding to the shape of the anti-tragus notch of the ear when the housing is placed in the ear.

18. The earphone as claimed in claim 13, wherein the second space is larger than the first space and is operatively connected to the sound output unit.

19. The earphone as claimed in claim 18, further comprising:

a bushing member combined with the housing, the bushing member supporting a cord which is connected to the electroacoustic transducer to enter from the outside of the housing.

20. The earphone as claimed in claim 19, wherein the first space is operatively connected to a cord hole of the bushing member.

21. The earphone as claimed in claim 13, further comprising:

a cover that covers a portion of the housing that contacts the ear, the cover including an exit corresponding to the sound output unit.

22. An earphone comprising:

an electroacoustic transducer for converting an audio signal into sound; and a housing for holding the electroacoustic transducer, the housing including a sound output unit for introducing the sound produced by the electroacoustic transducer into the external auditory meatus of an ear when the housing is placed in the ear, wherein a sound-emitting surface of the electroacoustic transducer is at an angle of 90°±10° with respect to a side of the cavum concha when the housing is placed in the ear; and wherein the housing comprises a first space located in the rear of the electroacoustic transducer, a second space located in the front of the electroacoustic transducer, and a front opening adjacent to the front of the electroacoustic transducer and operatively connecting the second space to the outside, the front opening controlling a bass response of the sound emitted from the electroacoustic transducer.

23. An earphone comprising:

a housing adapted to hold an electroacoustic transducer, the housing including a sound output unit for introducing sound emitted by the electroacoustic transducer into an ear canal of an ear, the housing holding a sound-emitting surface of the electroacoustic transducer in a direction transverse to the ear canal;

wherein the housing comprises a front housing disposed at the front of the electroacoustic transducer; and a rear housing disposed at the rear of the electroacoustic transducer, the rear housing forming a first space located in the rear of the electroacoustic transducer, the front housing forming a second space located in the front of the electroacoustic transducer; and wherein the housing further comprises at least one opening connecting the first space to an exterior of the housing, the at least one opening controlling a treble response of the sound emitted from the electroacoustic transducer.

24. The earphone as claimed in claim 23, wherein the electroacoustic transducer emits sound in a direction substantially parallel to the cavum concha.

25. The earphone as claimed in claim 23, wherein the second space is larger than the first space and is operatively connected to the sound output unit.

26. An earphone comprising:

a housing adapted to hold an electroacoustic transducer, the housing including a sound output unit for introducing sound emitted by the electroacoustic transducer into an ear canal of an ear, the housing holding a sound-emitting surface of the electroacoustic transducer in a direction transverse to the ear canal;

wherein the housing comprises a front housing disposed at the front of the electroacoustic transducer; and a rear housing disposed at the rear of the electroacoustic transducer, the rear housing forming a first space located in the rear of the electroacoustic transducer, the front housing forming a second space located in the front of the electroacoustic transducer; and wherein the housing further comprises at least one opening connecting the second space to an exterior of the housing, the at least one opening controlling a bass response of the sound emitted from the electroacoustic transducer.

27. An earphone, comprising:

a front housing;

a rear housing connected to the first housing to form an interior space, the interior space comprising a first space between the electroacoustic transducer and the rear housing and a second space between the electroacoustic transducer and the front housing;

an electroacoustic transducer for emitting sound disposed in the interior space formed by the front and rear housings, the electroacoustic transducer emitting sound in a first direction;

a sound output unit for transmitting sound emitted by the electroacoustic transducer into an ear canal of an ear in a second direction; and at least one opening connecting the first space to an exterior of the housing, wherein the at least one opening controls the treble response of the sound emitted from the electroacoustic transducer wherein the first and second directions are transverse to one another.

28. The earphone as claimed in claim 27, wherein the first and second directions are at an angle in the range of approximately 80° to 100° with respect to one another.

29. The earphone as claimed in claim 28, wherein the first and second directions are at an angle of approximately 90° with respect to one another.

30. An earphone, comprising:

a front housing;

a rear housing connected to the first housing to form an interior space, the interior space comprising a first space between the electroacoustic transducer and the rear housing and a second space between the electroacoustic transducer and the front housing;

an electroacoustic transducer for emitting sound disposed in the interior space formed by the front and rear housings, the electroacoustic transducer emitting sound in a first direction;

a sound output unit for transmitting sound emitted by the electroacoustic transducer into an ear canal of an ear in a second direction; and at least one opening connecting the second space to an exterior of the housing, wherein the at least one opening controls the bass response of the sound emitted from the electroacoustic transducer;

wherein the first and second directions are transverse to one another.

* * * * *